US006145618A

United States Patent [19]

Verenski

[11] Patent Number: 6,145,618

[45] **Date of Patent: *Nov. 14, 2000**

[54] LADDER SYSTEM AND METHOD OF CLIMBING HAVING A RAIL WITH A NON-LINEAR SLOT

[75] Inventor: Douglas R. Verenski, Enon Valley, Pa.

[73] Assignee: Werner Co., Greenville, Pa.

[ * ] Notice: Under 35 U.S.C. 154(b), the term of this patent shall be extended for 312 days.

[21] Appl. No.: 08/592,109

[22] Filed: Jan. 26, 1996

[51] Int. Cl.[7] ..... E04G 5/02

[52] U.S. Cl. ..... 182/111; 182/109

[58] Field of Search ..... 182/108, 109, 182/111

[56] References Cited

U.S. PATENT DOCUMENTS

| | | | |
|---|---|---|---|
| 47,265 | 4/1865 | Allamby et al. | 182/108 X |
| 886,282 | 4/1908 | Waters | 182/111 X |
| 1,656,817 | 1/1928 | Deppe | 182/109 |
| 2,196,640 | 4/1940 | Meier | 182/111 X |
| 2,309,484 | 1/1943 | Van Meter | 182/109 |
| 2,371,460 | 3/1945 | Needham | 182/108 X |
| 3,456,757 | 7/1969 | Sain | 182/111 |
| 4,415,062 | 11/1983 | Shaw | 182/111 X |
| 4,826,122 | 5/1989 | Cupp | 182/111 X |
| 5,154,255 | 10/1992 | Kiska et al. | 182/111 |
| 5,339,921 | 8/1994 | Faupel | 182/111 |
| 5,370,203 | 12/1994 | Kiska | 182/111 |

FOREIGN PATENT DOCUMENTS

| | | | |
|---|---|---|---|
| 846081 | 7/1955 | United Kingdom | 182/111 |

*Primary Examiner*—Daniel P. Stodola
*Assistant Examiner*—Richard M. Smith
*Attorney, Agent, or Firm*—Ansel M. Schwartz

[57] ABSTRACT

A ladder system comprises first and second rails with at least one rung connected between and perpendicular to both rails. First and second non-linear rail slots are located adjacent the bottom of the respective rails. Also, the ladder system comprises first and second ladder shoes. First and second bolts extend through the first and second shoes, respectively, and the first and second slots, respectively, to moveably connect the first and second shoes to the first and second rails, respectively, with both slots of a shape so that each shoe can move about the bottom of each respective rail and each respective rail can rotate relative to each respective shoe inside each respective shoe without interference occurring between the rails and shoes. A method of climbing comprises placing the feet of ladder shoes attached to rails of a ladder system in a flat position on the ground at a first level with the rails vertically oriented relative to the ground and essentially the full weight of the ladder system on the ladder shoes. The rails are then rotated relative to the ladder shoes via a curved slot in the rails at least 15° while essentially the full weight of the ladder system is on the ladder shoes which are maintained essentially still on the ground.

13 Claims, 10 Drawing Sheets

LADDER SYSTEM AND METHOD OF CLIMBING HAVING A RAIL WITH A NON-LINEAR SLOT

FIELD OF THE INVENTION

The present invention is related to a ladder system having ladder shoes. More specifically, the present invention is related to a ladder system having ladder shoes where the ladder rails can rotate relative to the ladder shoes without interference between the rails and the shoes while the ladder shoes remain still on the ground and essentially all the weight of the ladder system is on the ladder shoes.

BACKGROUND OF THE INVENTION

Ladder rails have been made with slots which are linear or straight, as shown in FIG. 1. The bolt holding the ladder shoe to the rail extends through the ladder shoe through the slot. Typically, the rail may rotate slightly within the ladder shoe with the bolt sliding down a slot until the edge of the rail contacts or is interfered with by the ladder shoe, as shown in FIG. 2. If the ladder rail is continued to be pivoted or rotated without the rail being lifted off of the ladder shoe foot so the bolt slides to the bottom of the slot, then the entire shoe is caused to be pivoted or rotated with the rail, as shown in FIG. 3. This causes the stable base the shoe affords the ladder to be lost since the ladder shoe is now basically resting on its edge.

An attempt to overcome this problem of the shoe rotating with the rail as the rail is pivoted, unless the rail is lifted relative to the shoe, is found in U.S. Pat. No. 5,154,255 of Werner Co. which discloses a ladder shoe with a curved slot. As the ladder rail rotates relative to the ladder shoe with the curved slot, the rotation essentially corresponds with the curvature of the slot and the ladder rail is allowed to pivot along the slot relative to the shoe so the shoe or the slot do not interfere with the movement of the rail. Typically, a shoe that contains a curved slot must be made larger than others to contain the curved slot.

The present invention involves a non-linear or curved slot which is cut into the rail instead of the shoe. Putting the curved slot in the rail allows for a smaller, lighter weight and cheaper shoe.

SUMMARY OF THE INVENTION

The present invention pertains to a ladder system. The ladder system comprises a first rail having a top and a bottom, and a first non-linear rail slot in proximity to the bottom. The ladder system also comprises a second rail having a top and a bottom, and a second non-linear rail slot in proximity to the bottom. Preferably, the first and second non-linear rail slots, are of a curved shape. The first rail and second rail preferably each have a web portion and a flange portion which extends from the web portion. The first rail slot is preferably in the web portion of the first rail and the second rail slot is in the web portion of the second rail. The first rail and second rail are preferably made of aluminum, although they can also be made of fiberglass. The second rail is disposed adjacent to and in parallel with the first rail.

Moreover, the ladder system comprises at least one rung connected to and in perpendicular relationship with the first rail and the second rail. Also, the ladder system comprises a first ladder shoe. There is also a first bolt extending through the first ladder shoe and the first rail slot to moveably connect the first ladder shoe to the first rail with the first non-linear rail slot of a shape so the first ladder shoe can move about the bottom of the first rail and the first rail can rotate relative to the first ladder shoe inside the first ladder shoe without interference occurring between the first rail and the first ladder shoe. Additionally, the ladder system comprises a second ladder shoe. There is also a second bolt extending through the second ladder shoe and the second rail slot to moveably connect the second ladder shoe to the second rail with the second non-linear rail slot of a shape so the second ladder shoe can move about the bottom of the second rail and the second rail can rotate relative to the second ladder shoe inside the second ladder shoe without interference occurring between the second rail and the second ladder shoe. Preferably each bolt is load bearing when the first rail and second rail are in a vertical position relative to ground during use.

The present invention pertains to a method for climbing from a first level to a second level. The method comprises the steps of placing feet of ladder shoes attached to rails of a ladder system in a flat position on the ground at the first level with the rails vertically oriented relative to the ground and essentially the full weight of the ladder system on the ladder shoes. Next, there is the step of rotating the rails of the ladder system relative to the ladder shoes via a curved slot in the rails at least 15° while essentially the full weight of the ladder system is on the ladder shoes which are maintained essentially still on the ground. Then, there is the step of climbing the ladder system to the second level.

The present invention also pertains to a method for forming a ladder.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 3:
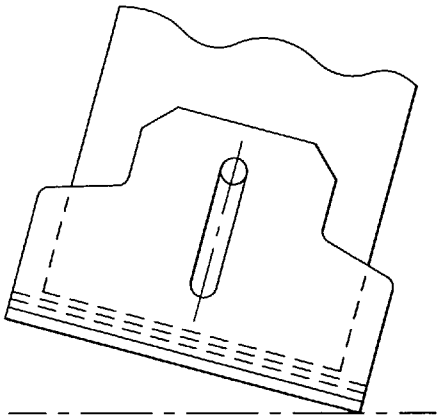
FIG. 3 is a schematic representation of a prior art ladder shoe and rail in a working position.
Figure 2:
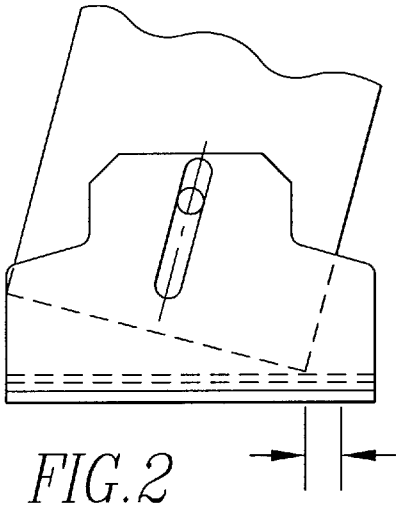
FIG. 2 is a schematic representation of a prior art rail slightly rotated until it contacts the ladder shoe.
Figure 1:
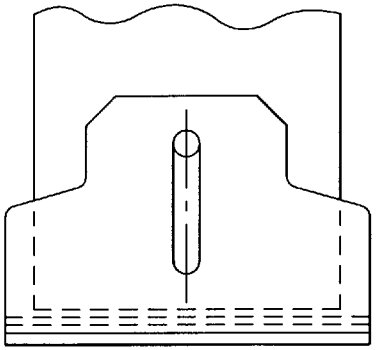
FIG. 1 is a schematic representation of the prior art ladder shoe and rail in a vertical position.

Referring now to the drawings wherein like reference numerals refer to similar or identical parts throughout the several views, and more specifically to FIGS. 4*a*, 4*b*, 4*c*, 4*d* and 4*e* thereof, there is shown a ladder system 10. The ladder system 10 comprises a first rail 12 having a top 14 and a bottom 16, and a first non-linear rail slot 18 in proximity to the bottom 16. The ladder system 10 also comprises a second rail 20 having a top 14 and a bottom 16, and a second non-linear rail slot 22 in proximity to the bottom 16. Preferably, the first and second non-linear rail slots 18, 22 are of a curved shape. The first rail 12 and second rail 20 preferably each have a web portion 34 and a flange portion 36 which extends from the web portion 54. The first rail slot 18 is preferably in the web portion 34 of the first rail 12 and the second rail slot 22 is in the web portion 34 of the second rail 20. The first rail 12 and second rail 20 are preferably made of aluminum, although they can also be made of fiberglass. The second rail 20 is disposed adjacent to and in parallel with the first rail 12. The rail slot 18 can be formed by piercing or stamping out the rail slot by well known techniques.

Moreover, the ladder system 10 comprises at least one rung 24 connected to and in perpendicular relationship with the first rail 12 and the second rail 20. Also, the ladder system 10 comprises a first ladder shoe 26. There is also a first bolt 28 extending through the first ladder shoe 26 and the first rail slot 18 to moveably connect the first ladder shoe 26 to the first rail 12 with the first non-linear rail slot 18 of a shape so the first ladder shoe 26 can move about the bottom 16 of the first rail 12 and the first rail 12 can rotate relative to the first ladder shoe 26 inside the first ladder shoe 26 without interference occurring between the first rail 12 and the first ladder shoe 26. Additionally, the ladder system 10 comprises a second ladder shoe 30. There is also a second bolt 32 extending through the second ladder shoe 30 and the second rail slot 22 to moveably connect the second ladder shoe 30 to the second rail 20 with the second non-linear rail slot 22 of a shape so the second ladder shoe 30 can move about the bottom 16 of the second rail 20 and the second rail 20 can rotate relative to the second ladder shoe 30 inside the second ladder shoe 30 without interference occurring between the second rail 20 and the second ladder shoe 30. Preferably each bolt 28, 32 is load bearing when the first rail 12 and second rail 20 are in a vertical position relative to ground 62 during use.

Figure 4A:
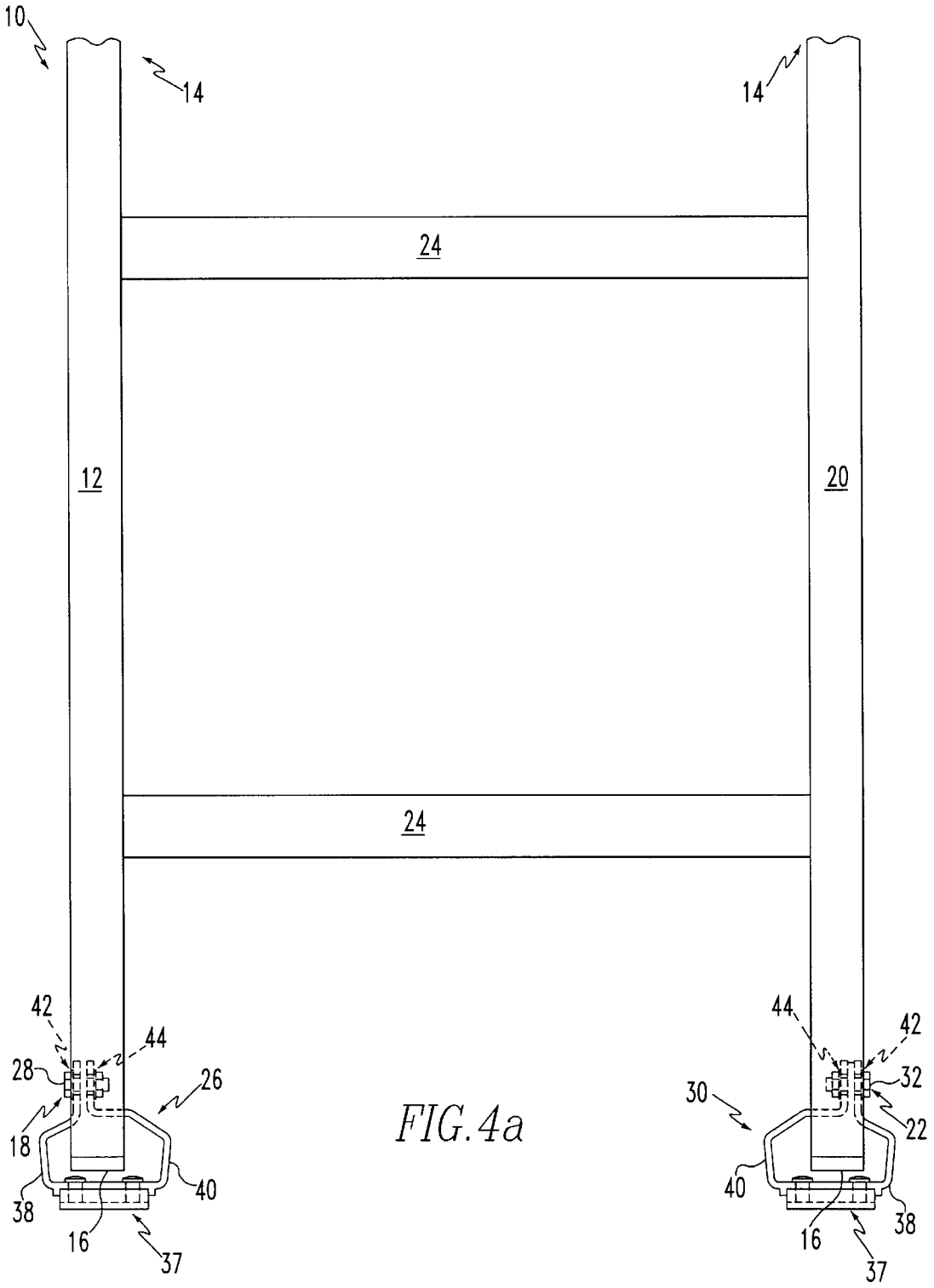
FIG. 4*a* is a front view of a ladder system of the present invention.
Figure 4B:
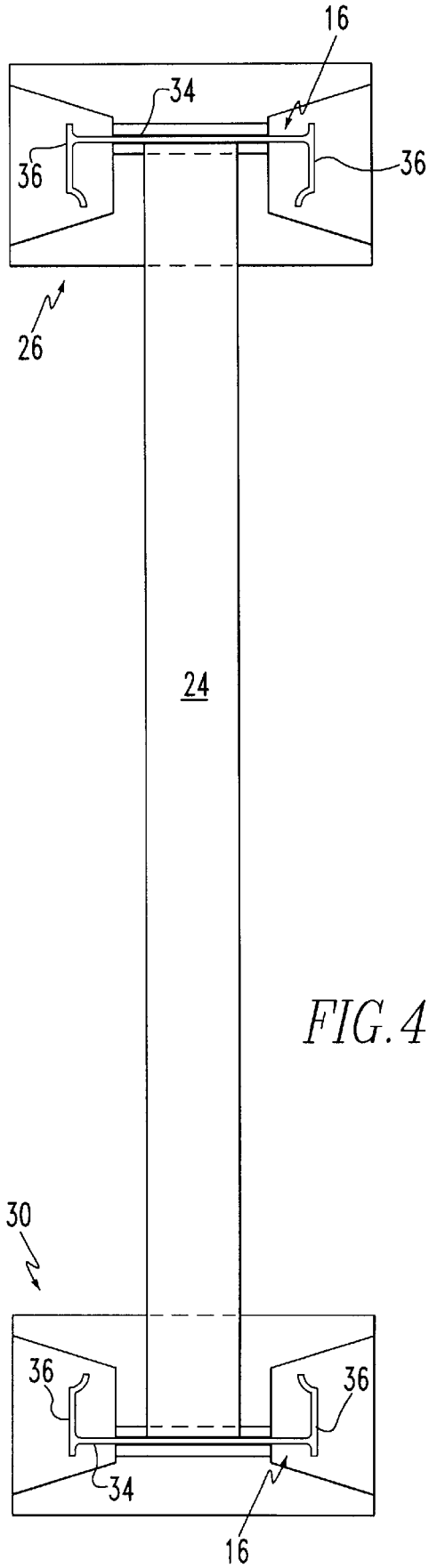
FIG. 4*b* is a schematic representation of a top view of the present invention.
Figure 4C:
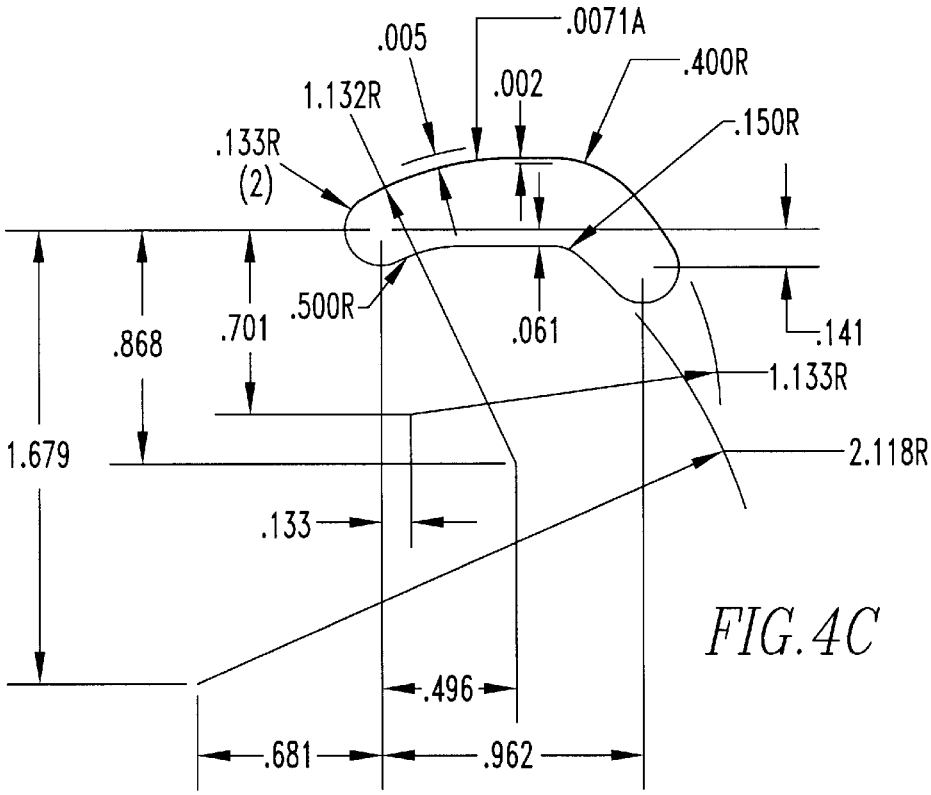
FIG. 4*c* is a detailed view of a slot of the preferred embodiment of the present invention.
Figure 4D:
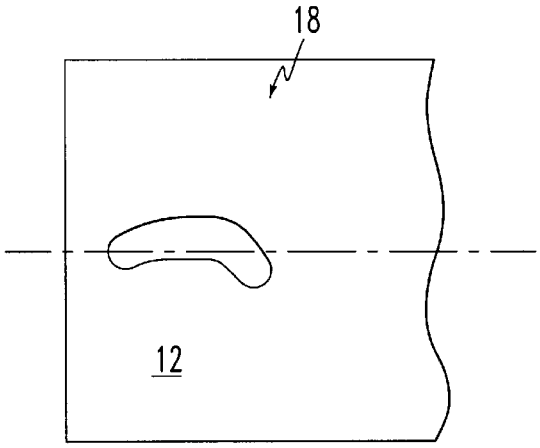
FIG. 4*d* is a schematic representation of a curved slot in a rail.
Figure 4E:
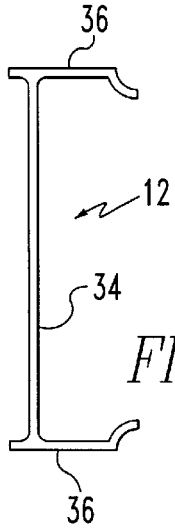
FIG. 4*e* is a schematic representation of a bottom view of a rail.
Figure 4G:
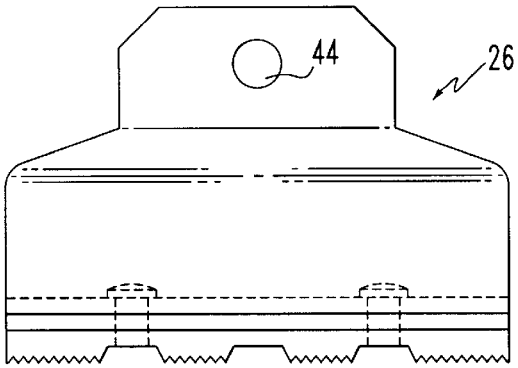
FIG. 4*g* is a schematic representation of a side view of a ladder shoe.
Figure 4F:
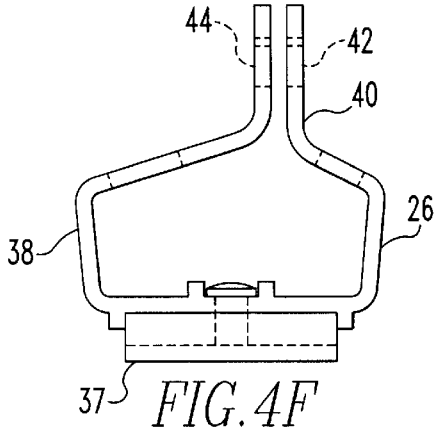
FIG. 4*f* is a schematic representation of a front view of a ladder shoe.
Figure 4H:
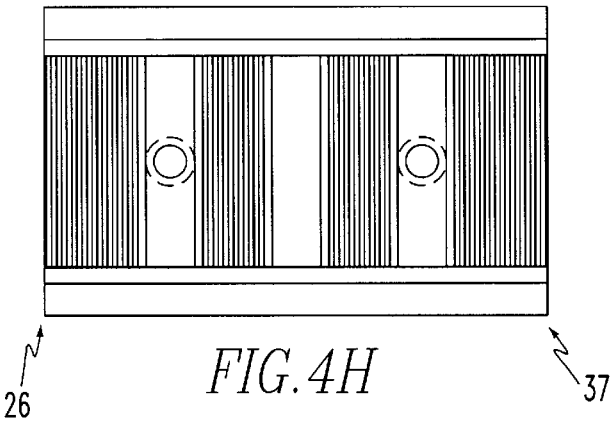
FIG. 4*h* is a schematic representation of a bottom view of a ladder shoe.

The first and second ladder shoes 26, 30 preferably each have a foot 37 and a first side wall 38 and a second side wall 40 which is in parallel and opposes the first side wall 38, as shown in FIGS. 4*f*, 4*g* and 4*h*. The first and second side walls 38, 40 extend from the foot 37. The first side wall 38 has a first bolt hole 42 and the second side wall 40 has a second bolt hole 24 in alignment with the first bolt hole 42. The first bolt 28 extends through the first bolt hole 22 of the first ladder shoe 26, first rail slot 18 in the second bolt hole 44 of the first ladder shoe 26 to moveably connect the first ladder shoe 26 to the first rail 12. The second bolt 32 extends through the first bolt hole 22 of the second ladder shoe 30, second rail slot 42 and second bolt hole 44 of the second ladder shoe 30 to moveably connect the second ladder shoe 30 to the second rail 20.

Figure 5:
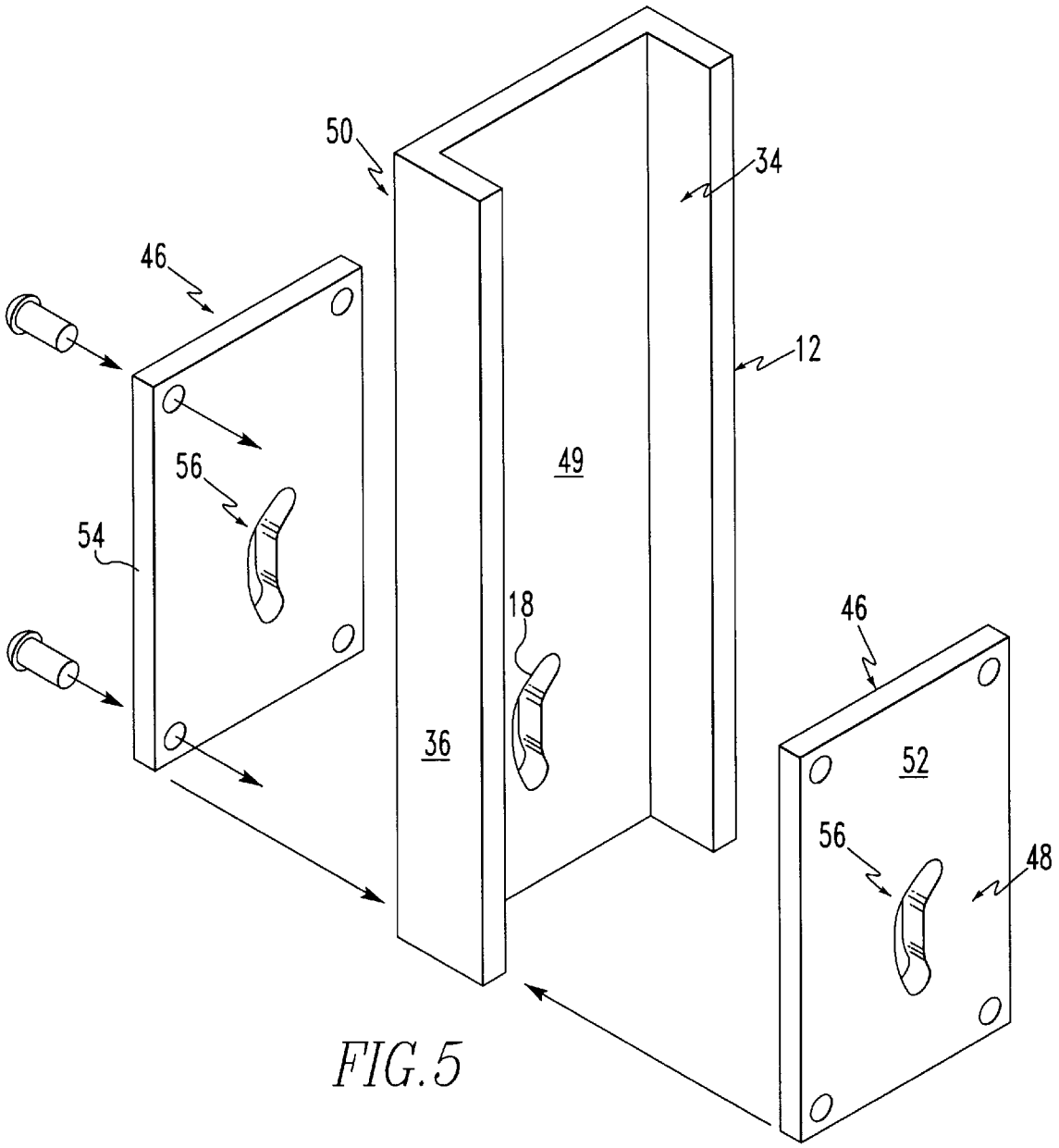
FIG. 5 is a schematic representation of an exploded view of a reinforcement plate and a rail having a curved slot.

If the first and second rails 12, 20 are made of fiberglass, then each rail 12, 20 preferably has a reinforcement plate 46 attached to the respective rail 12, 20, as shown in FIG. 5. Each reinforcement plate 46 has a plate slot 48 conforming with the shape of the respective rail slot 18, 22 and is in alignment with the respective rail slot 18, 22. The respective bolt 28, 32 extends through the respective reinforcement plate slot 46 and the respective rail slot 18, 22. The reinforcement plate 46 protects the respective rail 12, 20 from wear and damage by the respective bolt 28, 32.

Preferably, the web portion 34 has a front 49 and a back 50 and the reinforcement plate 46 is comprised of a front side 52 attached to the front 49 of the web portion 34 and a back side 54 attached to the back 50 of the web portion 34 and connected to the front side 52. The front side 52 and back side 54 each have a side slot 56 conforming and in alignment with the respective rail slot 18, 22. The front and back side slot 56 form the plate slot 48.

The present invention pertains to a method for climbing from a first level 58 to a second level 60. The method comprises the steps of placing feet 36 of ladder shoes 26, 30 attached to rails 12, 20 of a ladder system 10 in a flat position on the ground 62 at the first level 58 with the rails 12, 20 vertically oriented relative to the ground 62 and essentially the full weight of the ladder system 10 on the ladder shoes 26, 30. Next, there is the step of rotating the rails 12, 20 of the ladder system 10 relative to the ladder shoes 26, 30 via a curved slot 42 in the rails 12, 20 at least 15° while essentially the full weight of the ladder system 10 is on the ladder shoes 26, 30 which are maintained essentially still on the ground 62. Then, there is the step of climbing the ladder system 10 to the second level 60.

Preferably, after the step of climbing, there are steps of moving the ladder system 10. Next, there is the step of rotating the ladder shoes 26, 30 via the rail slots 18, 22 in the rails 12, 20 until the feet 36 of the ladder shoes 26, 30 are essentially in parallel with the rails 12, 20. Then, there is the step of placing the ladder system 10 on the ground 62 so spur plates 64 of the ladder shoes 22, 30 penetrate into the ground 62. It should be noted that only ladders having ladder shoes specifically made to be used in a "spiked" position should be used in such a mode of operation.

Figure 8:
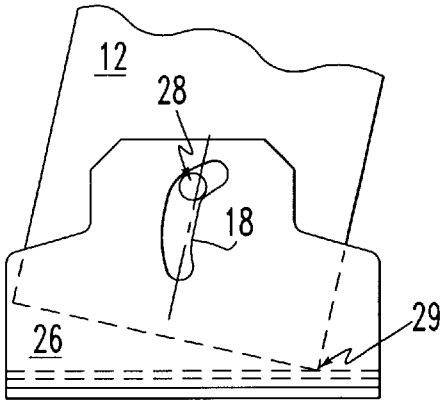
FIG. 8 is a schematic representation of a rail with a curved slot and a ladder shoe in a working position.
Figure 7:
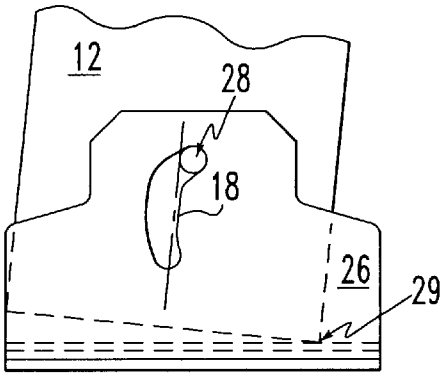
FIG. 7 is a schematic representation of a rail with a curved slot and a ladder shoe where the rail has rotated about five degrees relative to the ladder shoe.
Figure 6:
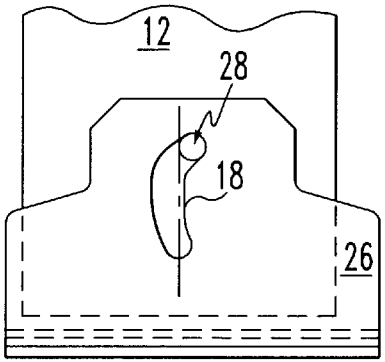
FIG. 6 is a schematic representation of a rail with a curved slot and a ladder shoe in a vertical position.

In the operation of the preferred embodiment, the bolt 28 of the ladder shoe 26 contacts the top of the slot 18 when the weight of the rail 12 and whatever is on it is bearing upon the foot 37 of the shoe 26 and the shoe 26 is flat against the ground 62 as shown in FIG. 6. Upon initial rotation of the rail 12 about the bolt 28, the edge 29 of the rail 12 contacts the foot 37 of the ladder shoe 26. This initial contact occurs after about five degrees of rotation of the rail 12 relative to the shoe 26, as shown in FIG. 7. The next or last ten degrees of rotation of the rail 12 to place it into a working position of about fifteen degrees from vertical occurs by the edge 29 of the rail 12 rotating about its point of contact with the foot 37 of the ladder shoe 26 and the bolt 28 moving along the curvature of the slot 18 as it moves so the bolt 28 does not contact or is interfered with by the slot 18. As shown in FIG. 8, the bolt 28 has a clear path of travel so there is nothing to prevent the rail 12 from rotating within the shoe 26 while the shoe 26 remains fixed on the ground 62.

Figure 9B:
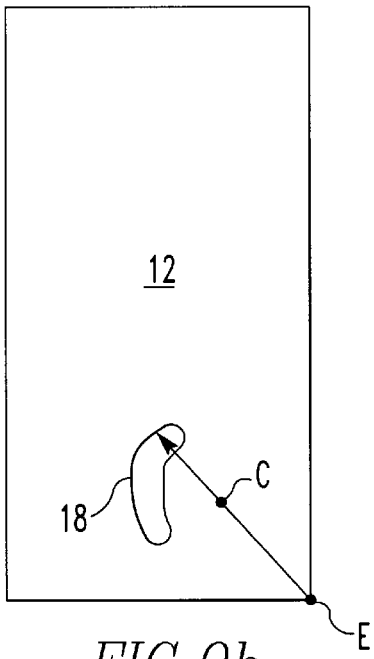
FIG. 9*b* is a schematic representation of a rail with a slot regarding the center of curvature.
Figure 9A:
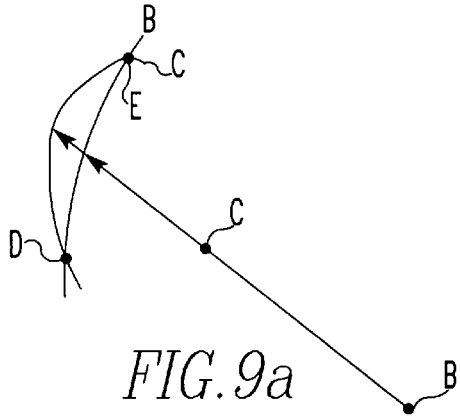
FIG. 9*a* is a representation of the curvature regarding the slot.

The slot is generally designed in the following way. As shown in FIGS. 9*a* and 9*b*, the portion of the slot is designated with an arrow is an arc about pt. C. The actual path needed for the bolt 28 to follow without interference is about pt. B. By adjusting the center of curvature from B to C, the rail 12 is allowed to wear at pt. E without any interference occurring between the bolt 28 and slot 18.

Figure 10:
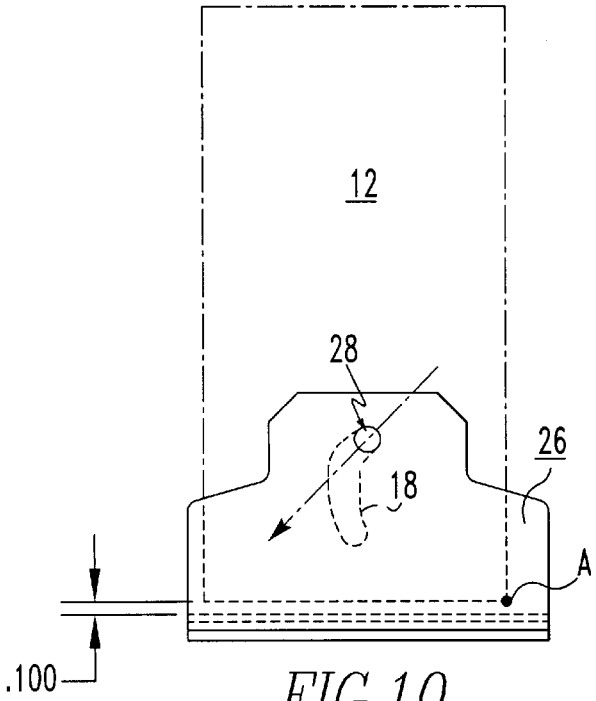
FIG. 10 is a schematic representation of a rail with a curved slot and a ladder shoe.

In regard to the rail 12 connected to the shoe 26, the bottom position of the rail 12 when it is vertical is depicted in FIG. 10. There is a gap of 0.100 inches between the bottom of the rail 12 and shoe 26. This gap was designated so that the ladder rail 12 would initially rotate 3°–4° about the bolt 28. The gap could be eliminated, but the slot needs to then be elongated in the direction of the arrow so that the slot 18 can move without interference along the bolt 28 is 15° from the vertical (working position).

Figure 11:
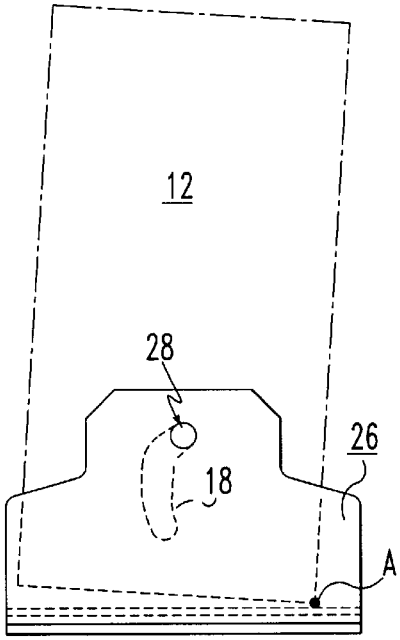
FIG. 11 is a schematic representation of a rail with a curved slot and a shoe where the rail is slightly rotated until it contacts the shoe.
Figure 12:
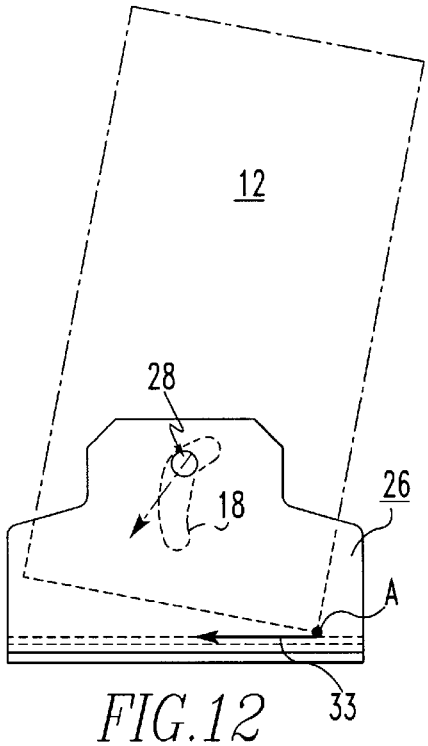
FIG. 12 is a schematic representation of a rail with a curved slot and a ladder shoe in a working position.

Once the edge 29 of the rail 12 (pt. A) comes in contact with the shoe 26, the center of rotation of the rail 12 becomes pt. A, as shown in FIG. 11. From this pt. A, the rail 12 need only rotate approximately 11° more until it is in the working position (approx. 15° from the vertical) shown in FIG. 12. Up until this position, the path of movement of the slot 18 and bolt 28 coincided with each other. Further rotation will result in the rail sliding in the shoe, as shown by the arrow 33.

Figure 13:
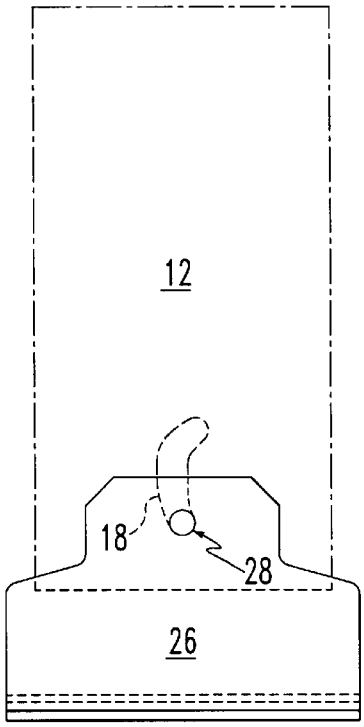
FIG. 13 is a schematic representation of a rail with a curved slot and a ladder shoe with essentially no load on the ladder shoe.
Figure 14:
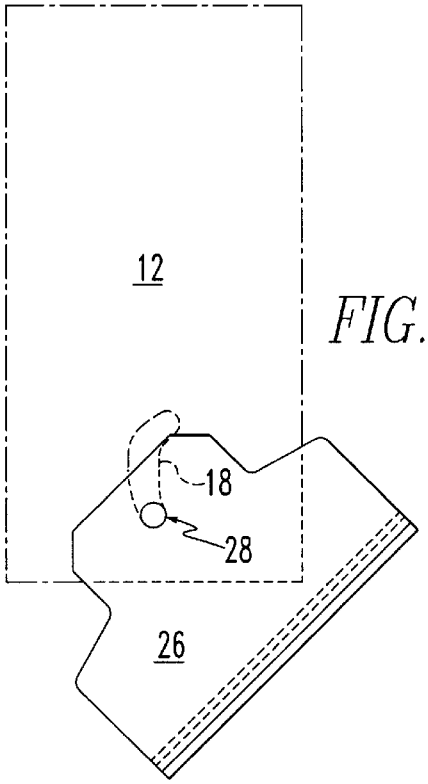
FIG. 14 is a schematic representation of a ladder shoe rotating about a rail with a curved slot.
Figure 15:
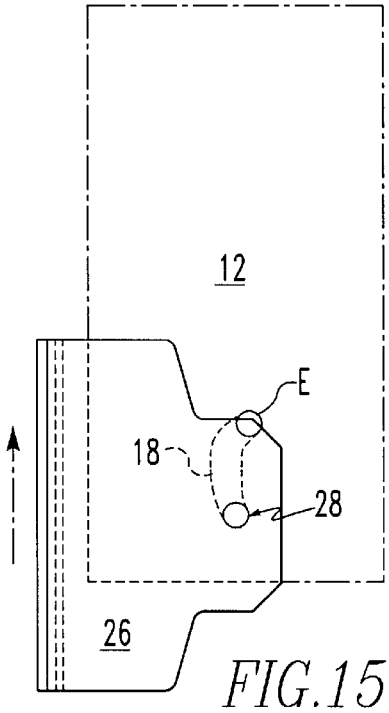
FIG. 15 is a schematic representation of a rail with a curved slot and a ladder shoe in a spike position.
Figure 16:
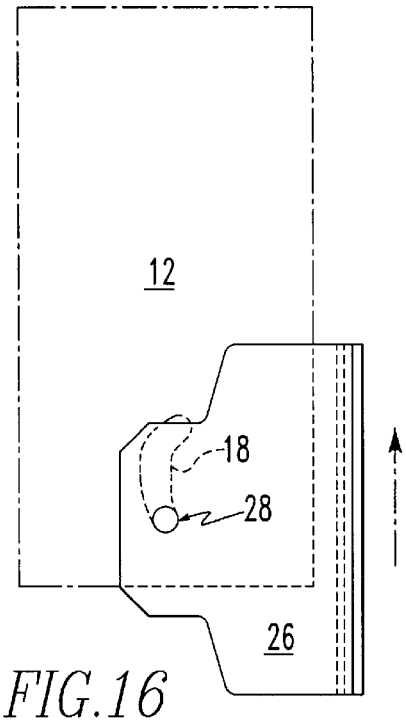
FIG. 16 is a schematic representation of a rail with a curved slot and a ladder shoe in a position used for shipping.

FIG. 13 shows the shoe 26 hanging freely from the rail 12, such as when the ladder system 16 is lifted vertically off the ground so there is no weight on the shoe 26. From this position, the shoe can be rotated in either direction to the positions shown in FIG. 15 and FIG. 16 through the position shown in FIG. 14. From these positions, the shoe 26 can be moved upward in the direction of arrows until the bolt is in position E. FIG. 16 shows a position of the shoe 26 and rail 12 used for shipping and FIG. 15 shows a position of the shoe 26 and rail 12 used for a spike position.

Standard aluminum ladder rail is used. No special changes are made or need to be made to the rail to receive or withstand the forces that are present at the rail slot during normal operation. The rail 12 to be used is dictated by the requirements to be met. For instance, Type IA, I, II or III rails can be used which meet ANSI Code 14.2 for metal rails and ANSI Code 14.5 for fiberglass rails. Preferably, standard rails having a web portion of 2.5 inches to 3.03 inches are used although larger rails can also be used.

Putting a curved slot in the ladder rail makes a left and right rail of what is presently considered not to be sided at that point in the manufacturing process. Thus, during all subsequent stages of manufacturing, the rails must be treated as left and right parts. Secondly, due to the fact that the rails are sided, the curved slot is preferably pierced at opposite orientations. This means that one rail must be pierced from one side (flange up) and the other rail from the opposite side (flange down).

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A ladder system comprising:

a first rail having a top and a bottom, and a first non-linear rail slot in proximity to the bottom;

a second rail having a top and a bottom, and a second non-linear rail slot in proximity to the bottom, said second rail disposed adjacent to and in parallel with the first rail;

at least one rung connected to and in perpendicular relationship with the first rail and the second rail;

a first ladder shoe;

a first bolt extending through the first ladder shoe and the first rail slot to moveably connect the first ladder shoe to the first rail with the first non-linear rail slot of a shape so the first ladder shoe can move about the bottom of the first rail and the first rail can rotate relative to the first ladder shoe inside the first ladder shoe without interference occurring between the first rail and the first ladder shoe;

a second ladder shoe; and a second bolt extending through the second ladder shoe and the second rail slot to moveably connect the second ladder shoe to the second rail with the second non-linear rail slot of a shape so the second ladder shoe can move about the bottom of the second rail and the second rail can rotate relative to the second ladder shoe inside the second ladder shoe without interference occurring between the second rail and the second ladder shoe.

2. A ladder system as described in claim 1 wherein the first and second non-linear rail slots are of a curved shape.

3. A ladder system as described in claim 2 wherein the first rail and second rail each have a web portion and a flange portion which extends from the web portion, said first rail slot in the web portion of the first rail and said second rail slot in the web portion of the second rail.

4. A ladder system as described in claim 3 wherein the first and second ladder shoes each have a foot and a first side wall and a second side wall which is in parallel and opposes the first side wall, said first and second side walls extending from said foot, said first side wall having a first bolt hole and said second side wall having a second bolt hole in alignment with said first bolt hole, said first bolt extending through said first bolt hole of the first ladder shoe, first rail slot and said second bolt hole of the first ladder shoe to moveably connect the first ladder shoe to the first rail, said second bolt extending through said first bolt hole of the second ladder shoe, second rail slot and second bolt hole of the second ladder shoe to moveably connect the second ladder shoe to the second rail.

5. A ladder system as described in claim 4 wherein the first rail and second rails are made of aluminum.

6. A ladder system as described in claim 4 wherein the first rail and second rail are made of fiberglass.

7. A ladder system as described in claim 6 wherein the first rail and second rail each have a reinforcement plate attached to the respective rail, each reinforcement plate having a plate slot conforming with the shape of the respective rail slot and in alignment with the respective rail slot, said respective bolt extending through said respective reinforcement plate slot and said respective rail slot, said reinforcement plate protecting said respective rail from wear and damage by said respective bolt.

8. A ladder system as described in claim 7 wherein the web portion has a front and a back and the reinforcement plate is comprised of a front side attached to the front of the web portion and a back side attached to the back of the web portion and connected to the front side, said front and back side each having a side slot conforming and in alignment with the rail slot, said front and back slot forming said plate slot.

9. A ladder system as described in claim 4 wherein each bolt is load bearing when the first rail and second rail are in a vertical position relative to ground during use.

10. A ladder rail comprising:

a web portion having a non-linear rail slot through which a bolt for attaching a ladder shoe to the web portion extends; and a flange portion which extends from the web portion.

11. A method for climbing from a first level to a second level comprising the steps of:

placing feet of ladder shoes attached to rails of a ladder system in a flat position on the ground at the first level with the rails vertically oriented relative to the ground and essentially the full weight of the ladder system on the ladder shoes;

rotating the rails of the ladder system relative to the ladder shoes via a curved slot in the rails at least 15° while essentially the full weight of the ladder system is on the ladder shoes which are maintained essentially still on the ground; and climbing the ladder system to the second level.

12. A method as described in claim 11 including after the step of climbing, there are steps of:

moving the ladder system;

rotating the ladder shoes via the rail slots in the rails until the feet of the ladder shoes are essentially in parallel with the rails; and placing the ladder system on the ground so spur plates of the ladder shoes penetrate into the ground.

13. A method for forming a ladder comprising the steps of:

piercing a first rail with a first curved slot while it is in a first orientation with its flange portion facing up;

piercing a second rail with a second curved slot while it is in an opposite orientation with its flange portion facing down so the first and second curved slots will align when assembled to form the ladder; and assembling the ladder by aligning the first and second rails and placing rungs between them and connecting ladder shoes to the rails through the respective slots.

* * * * *